US006488149B1

(12) United States Patent
Montagnino

(10) Patent No.: US 6,488,149 B1
(45) Date of Patent: Dec. 3, 2002

(54) ELECTRONIC HEATING PAD STORAGE CONTAINER

(75) Inventor: James G. Montagnino, St. Charles, IL (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 09/675,521

(22) Filed: Sep. 29, 2000

(51) Int. Cl.[7] ..... B65D 85/00

(52) U.S. Cl. ..... 206/320; 53/471; 219/201; 219/528

(58) Field of Search ..... 206/37, 320, 446, 206/459.1, 459.5, 521, 525, 701, 702, 720, 806; 53/467, 468, 471; 383/72, 75, 76; 607/98, 112, 114, 108; 219/201, 202, 211, 212, 385, 386, 528, 529, 526, 527

(56) References Cited

U.S. PATENT DOCUMENTS 2,745,942 A * 5/1956 Cohen ..... 219/528
3,275,180 A * 9/1966 Optner et al. ..... 206/521
3,623,485 A * 11/1971 Price ..... 607/112
4,205,750 A * 6/1980 Dews ..... 206/521
4,736,088 A * 4/1988 Bart ..... 219/211
4,739,880 A * 4/1988 Sawyer et al. ..... 383/72
5,111,810 A * 5/1992 Fortney ..... 607/108
5,436,429 A * 7/1995 Cline ..... 219/526
5,520,307 A * 5/1996 Miller et al. ..... 206/459.5
5,637,247 A * 6/1997 Flynn, Jr. ..... 219/528
5,835,983 A * 11/1998 McMahen et al. ..... 219/527
5,896,996 A * 4/1999 Chuang ..... 206/806

* cited by examiner

*Primary Examiner*—Luan K. Bui
(74) *Attorney, Agent, or Firm*—Kramer, Levin, Naftalis & Frankel LLP

(57) ABSTRACT

A point-of-sale storage device for an electronic heating pad includes a storage tube and a lid that removably attaches to the storage tube. The storage tube may be clear plastic, and coloring may be added to distinguish different models of electronic heating pads. A method for storing the electronic heating pad includes coiling a cord and controller assembly attached to the pad, placing the coiled cord and controller assembly along an edge of the pad parallel to straight sections of heating wire within the pad, rolling the pad in a direction so as to roll the pad around the coiled cord and controller assembly, inserting the rolled pad into the storage tube, and closing the storage tube with the lid. Optionally, the rolled pad may be inserted into a cloth sleeve prior to inserting the rolled pad covered with the cloth sleeve into the storage tube.

12 Claims, 2 Drawing Sheets

ELECTRONIC HEATING PAD STORAGE CONTAINER

FIELD OF THE INVENTION

The present invention relates to storage devices, including point-of-sale containers, and more specifically a storage container for an electronic heating pad.

BACKGROUND INFORMATION

Point-of-sale storage devices are well-known in the art. Just about any container can qualify as a point-of-sale storage device. However, most point-of-sale containers are designed to protect their contents and be durable. Cardboard boxes are common point-of-sale containers because they are inexpensive, receive printing well, provide a rigid structure for protection, and are durable. Plastic is also commonly used to construct point-of-sale containers because it may be used to make containers that are air-tight, waterproof, rigid or flexible, and shaped into almost anything. Furthermore, many point-of-sale containers function as storage devices for their contents after purchase.

For example, tennis balls frequently are sold in rigid, clear plastic tubes that have been pressure-sealed to keep the balls from going flat prior to use. The pressurization often is accomplished by a metal cap having a peel-away center that is removed upon opening, permanently depressurizing the tube. Although the tube will not keep the balls from going flat once the tube has been opened and depressurized, the tube may be used to store the balls between uses by virtue of a plastic lid that usually covers the metal cap at the point of purchase. By contrast, were the plastic lid not to accompany the tube, the tube would not be useful as a storage device once opened because the peel-away center is permanently separated from the rim of the metal cap. Storing the balls in the tube conveniently prevents the balls from rolling and bouncing between uses, but it does little to protect the balls from deterioration (e.g., going flat).

Although the way in which tennis balls are stored may not greatly affect their performance, the same is not true of electronic heating pads. Heating pads tend to be cumbersome to store. Storage of heating pads often results in pad damage as consumers repeatedly fold the pads to store them, causing wire breakage and damage to the internal structure of the heating pad. Wire breakage may eventually result in a temporary short circuit that may cause a burn mark or melt spot at the pad.

Previous attempts to solve this problem have involved the design of rectangular hinged cases to store the pad in a confined area of a predetermined size. Unfortunately, such rectangular packaging attempts usually resulted again in customers making sharp folds while trying to press the pads into the rectangular shapes in hurried attempts to store the pad after use. Previous packaging attempts also have not provided desirable methods of storing the cord or controller attached to the pad. Customers frequently pushed the cord and controller into the package after the pad has been inserted. This also may result in failures at the cord where the cord exits from the pad due to the amount of force being applied in trying to repack the cord assembly into the pad box.

It would therefore be desirable to create a novel point-of-sale container capable of storing an electronic heating pad that would avoid many of the disadvantages associated with previous heating pad storage containers.

SUMMARY OF THE INVENTION

The present invention relates to an electronic heating pad storage container having a tube and a lid. In particular, the invention provides a storage tube for use as a point-of-sale container for an electronic heating pad. Use of a storage tube allows a consumer to roll up the electronic heating pad without applying sharp bends or creases to the pad prior to insertion of the rolled pad into the tube. Forming the pad into a tubular roll also permits a consumer conveniently to tuck the cord assembly with the controller into the center of the rolled up pad. Optionally, the rolled pad may be inserted into a cloth sleeve closed at one end and having a drawstring at the open end prior to inserting the sleeve into the storage tube. Once the rolled pad is inserted into the storage tube, the storage tube may be closed with a push-in end cap, a screw-top or a snap-on lid. Use of such a storage tube should lengthen the useful life of a pad and avoid the damaging handling of the pad that may result in short circuits, wire breakage, electrical burns, or pad failure. The overall benefits may include greater customer satisfaction and fewer product returns.

Other features and advantages of the present invention will be apparent from the following description of the exemplary embodiments thereof, and from the claims.

DETAILED DESCRIPTION

Figure 1:
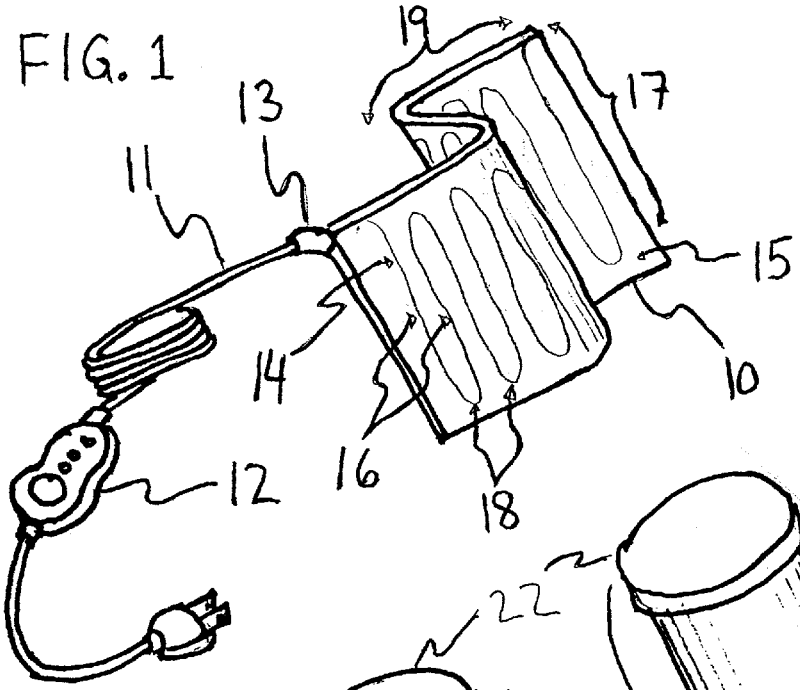
FIG. 1 is a perspective view of an exemplary electronic heating pad with an attached cord and controller assembly.

FIG. 1 is a perspective view of an exemplary electronic heating pad 10 with an attached cord 11 and controller 12 assembly. The cord 11 exits the pad 10 at a connection 13. Within the pad 10, the cord 11 is coupled to heating wires 14 woven into the pad's 10 fabric 15. As with typical electronic heating pads, the pad 10 has heating wires 14 that have predominantly parallel sections 16 within the fabric 15 along a width 17 but that have curves 18 as the wires 14 progress back and forth along a length 19 of the pad 10.

Figure 2:
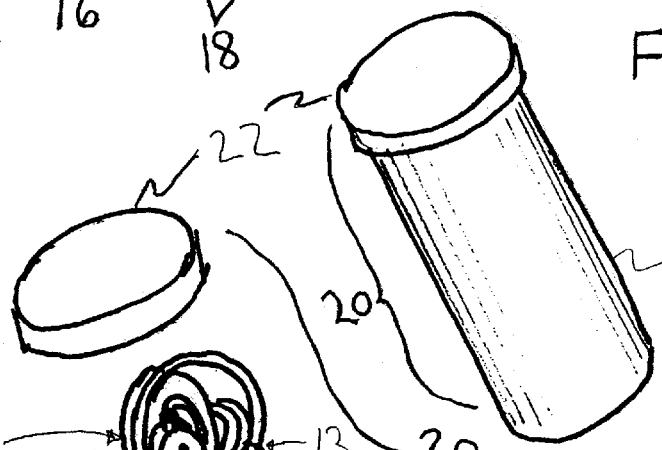
FIG. 2 is a perspective view of an exemplary electronic heating pad storage container according to an embodiment of the present invention in a closed condition.

Preferably, the pad 10 should be rolled so that wires 14 are bent as little as possible so as to minimize the likelihood that wires 14 would break or incur damage as a result of the rolling. In FIG. 1, therefore, the pad 10 preferably would be rolled along its length 19 so that its width 17 remains as straight as possible, as shown in FIG. 2. Similarly, the cord 11 and controller 12 preferably are bent as little as possible, so the cord 11 and controller 12 are coiled along width 17. The coiled cord 11 and controller 12 preferably are placed along the width 17 opposite the connection 13 so as to avoid excessively bending the connection 13. However, the coiled cord 11 and controller 12 may nonetheless be placed along the width 17 next to the connection 13.

Additionally, it also would be satisfactory to roll the pad At 10 widthwise so that the length 19 remains straight. When rolled widthwise, the coiled cord 11 and controller 12 likewise may be placed along the length 19. While it may be satisfactory to roll the pad 10 widthwise, the pad 10 likely may fit into a storage container 20 only when rolled in a specific direction. For example, if the storage container 20 is as long as the width 17, but the length 19 is longer than the container 20, then rolling the pad 10 widthwise will cause part of the pad 10 to stick out of the container, preventing its closure. Likewise, assuming the container 20 is as long as the length 19 and that the length 19 is longer than the width 17, then the container 20 may not be wide enough across to accommodate a pad 10 that has been rolled lengthwise if the container 20 were designed for a pad 10 that has been rolled widthwise. The exception is of course if the pad 10 is an even square, i.e., the width 17 equals the length 19, in which case the pad 10 may be rolled in either direction and still fit into the container 20. Naturally, the tube 21 could also be long enough and wide enough across to accommodate the pad 10 after having been rolled either lengthwise or widthwise, though such a tube 21 may occupy more space than desired.

FIG. 2 is a perspective view of an exemplary electronic heating pad storage container 20 in a closed condition according to an embodiment of the present invention. Storage container 20 may include a tube 21 and a lid 22. The tube 21 preferably is a little longer than width 17 to easily accommodate a rolled pad 23, rolled lengthwise. Similarly, the tube 21 should be wider than a loosely rolled pad 23, rolled lengthwise, to ensure an easy fit without needing to roll the pad 10 too tightly. The lid 22 as shown in FIGS. 2 and 3 represents a snap-on lid, but other types of lids are also appropriate, as discussed below.

The storage container 20 may be constructed of any suitable materials. Similarly, it is understood that any feasible combination of types of tube 21 and lid 22 may be used in accordance with the present invention. For example, the storage tube 21 could be made of corrugated cardboard having plastic push-in end caps; metal having a metal or plastic screw-top; or plastic having a plastic snap-on or hinged lid. Preferably, the storage tube 21 is made of rigid, clear plastic, which would permit printed sales sheets and product information sheets to be seen through the storage tube 21.

Figure 3:
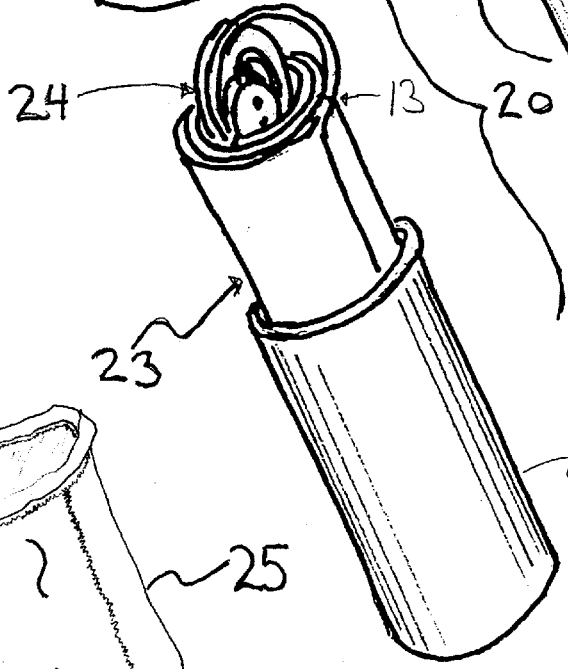
FIG. 3 is a perspective view of an exemplary electronic heating pad storage container according to an embodiment of the present invention in an open condition.

By comparison, FIG. 3 is a perspective view of the exemplary storage container 20 in an open condition according to an embodiment of the present invention. Preferably, the cord 11 and controller 12 are coiled along the width 17 opposite the connection 13 and form a center 24 of the rolled pad 23. The rolled pad 23 may then be inserted into tube 21, preferably with the connection 13 near the lid 22 to keep the connection 13 visible and avoid unknowingly bending the connection 13 too much.

Figure 4A:
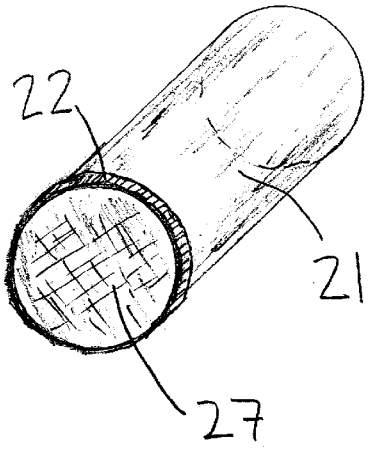
FIGS. 4A–4B show perspective views of exemplary electronic heating pad storage containers having, respectively, a circular cross-section and an oval-shaped cross-section, according to embodiments of the present invention in the closed condition.
Figure 4B:
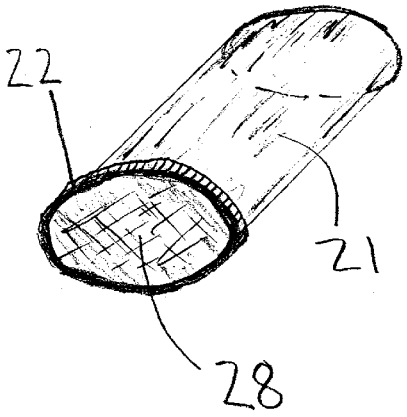

While the storage tube 21 may be cylindrical having a circular cross-section 27 as shown in FIG. 4A, it may be advantageous to have a non-circular cross-section, such as an oval-shaped cross-section 28, as shown in FIG. 4B. An oval-shaped cross-sectional tube 21 has the advantage of having lids 22 that only fit when inserted in one of two ways that align the oval-shaped cross-sections 28. This may be advantageous if the lids 22 have printed material that should be presented in a specific direction for easier reading. Moreover, tube 21 may have a variety of non-circular cross-sections, such as pentagonal, hexagonal, heptagonal, octagonal, etc. The basic limitation is that the tube 21 should be shaped to receive easily a rolled pad 23. As such, the cross-section will have either no distinct angles, such as with ovals and circles, or angles greater than 90 degrees, such as with pentagons and hexagons.

Figure 5A:
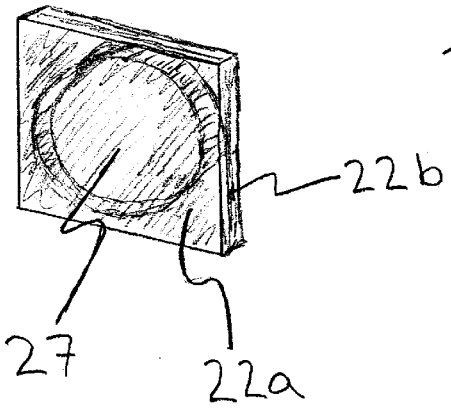
FIGS. 5A–5B show, respectively, perspective views of an exemplary lid having a rectangular outer surface and a stack of exemplary electronic heating pad storage containers having lids in the closed condition and closed ends with rectangular outer surfaces, according to embodiments of the present invention.
Figure 5B:
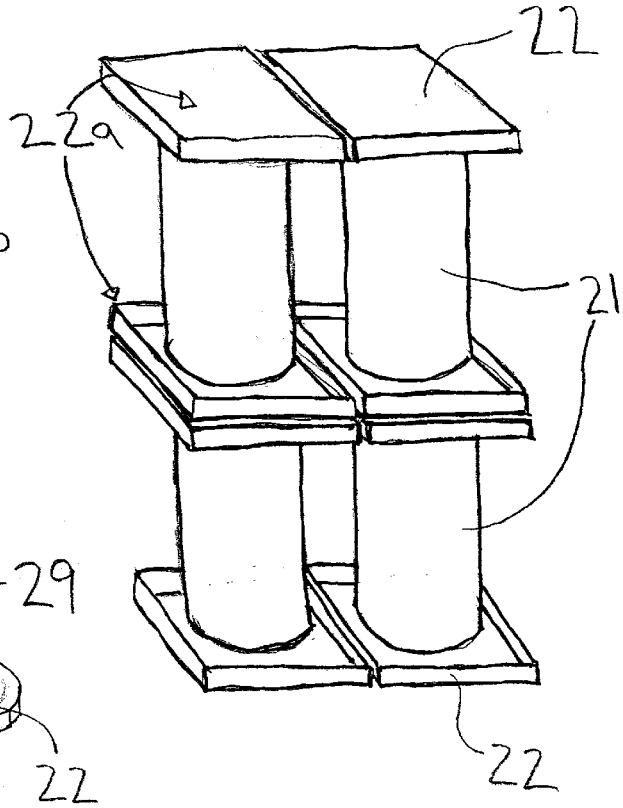

Furthermore, as shown in FIG. 5A, the lids 22 may have rectangular outer surfaces 22*a* to facilitate stacking and add stability. The rectangular outer surfaces 22*a* preferably would appear on both ends of the tube 21 to provide symmetry, as shown in FIG. 5B. When intended to be stored horizontally lengthwise, the rectangular outer surface 22*a* will prevent the storage container 20 from rolling, which a tube 21 of circular cross-section 27 may be prone to do. Furthermore, by virtue of the fact that the rectangular outer surface 22*a* has flat edges 22*b*, one storage container 20 may be stacked atop or beside another storage container 20, such as in FIG. 5B. Likewise, a rectangular outer surface would have a larger surface area than just the cross-section of the tube 21, so the tubes 21 would not crush each other during shipping.

In the event that the storage tube 21 has a non-circular cross-section with angular outer surfaces, i.e., distinct, flat faces, such as a pentagon or hexagon, for example, then the tube 21 also will be less likely to roll than a tube 21 having a circular cross-section. Instead of rectangular outer surfaces, a tube 21 having, for example, a hexagonal cross-section, may have a lid 22 that has angular outer surfaces which are also hexagonal in nature. A hexagonal tube and angular outer surfaces would also facilitate stacking in much the same way that rectangular outer surfaces improve stacking. The rectangular outer surfaces, however, would inhibit rolling of the tube 21 the most.

Figure 6:
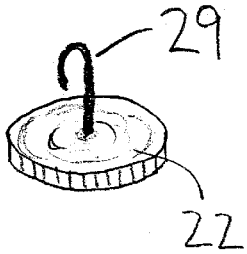
FIG. 6 is a perspective view of an exemplary electronic heating pad storage container lid having a hook according to an embodiment of the present invention.

Insofar as the storage container 20 need not be stacked at the point of sale, the container 20 may have a hanging support, such as a hook 29 attached to the outer surface of the lid 22, as shown in FIG. 6, to facilitate hanging of the container 20 at the point of sale. The support may be attached by means known in the art, such as gluing, piercing, molding or melting. Moreover, the support may be attached anywhere on the lid 22 or the tube 21, not just centrally on the outer surface, as long as the support may withstand the weight of the tube 21, lid 22, and rolled pad 23. Analogously, the hanging support may be any structure designed to be attached to a display to hang the container 20. The hanging support may be, for example, a loop, a bulb, or a clamp, instead of a hook 29.

Figure 7:
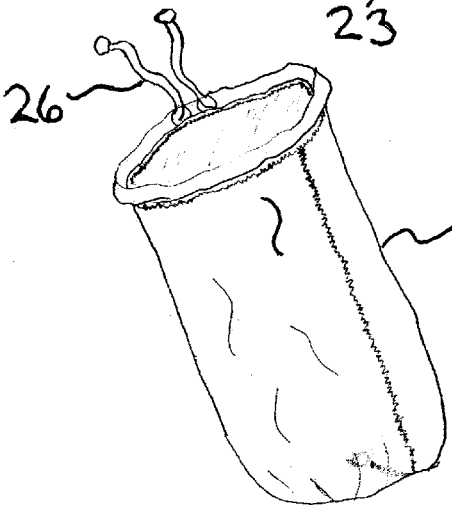
FIG. 7 is a perspective view of an exemplary electronic heating pad cloth sleeve having a drawstring according to an embodiment of the present invention.

Optionally, a cloth sleeve 25 as shown in FIG. 7 may be used to facilitate handling of the rolled pad 23. The cloth sleeve 25 may be made of any suitable fabric, for example, cotton, silk, polyester, nylon, acetate, lycra, spandex, or blends of these. The rolled pad 23 first may be inserted into the cloth sleeve 25, and second, the rolled pad 23 covered by the cloth sleeve 25 may be inserted into tube 21. In order to better view the rolled pad 23, the rolled pad 23 in FIG. 3 is depicted as having been inserted in the tube 21 without using the cloth sleeve 25. Sleeve 25 may have a drawstring 26 with which the sleeve 25 may be closed. The drawstring 26 also may be pulled to help remove from the tube 21 a rolled pad 23 covered by the sleeve 25.

As discussed above, the rolled pad 23 optionally may be inserted into the cloth sleeve 25 prior to being inserted into the storage tube 21. Cloth sleeves 25 of varying colors may be used to distinguish different models of electronic heating pads 10. Likewise, coloring may be added to the clear plastic for aesthetic reasons or to highlight features of various models and act as a simple method of coding the models. Transparent plastic storage tubes 21 of varying colors may reinforce consumer selection at the point of purchase. Additionally, transparent plastic storage tubes 21, whether colored or clear, may permit consumers to view the actual texture and fabric 15 of the various types of heating pads 10 without opening the tubes 21 and handling the product, which may result in damage and warranty returns from the retailer. If a cloth sleeve 25 is used, a portion of the pad 10 may need to be exposed outside the sleeve 25 to reveal the texture and fabric 15 of the pad 10.

A number of embodiments of the present invention have been described above. Nevertheless, it will be understood that various modifications may be made without departing from the spirit and scope of the invention. Accordingly, other embodiments may be within the scope of the following claims. It is intended that all matter contained in the above description or shown in the accompanying drawings shall be interpreted as illustrative and not in a limiting sense. It is also understood that the following claims are intended to cover all of the generic and specific features of the invention herein described and all statements of the scope of the invention, expressed or implied.

What is claimed is:

1. An electronic heating pad package comprising:

a storage tube having a closed end and an open end, a lid removably attachable to the open end of the storage tube, and an electronic heating pad having a first edge and a cord and controller assembly coupled to heating wiring within the pad;

wherein the pad is adapted to be rolled perpendicularly to the first edge around the cord and controller assembly coiled and lying parallel to the first edge, the tube is longer than the first edge of the pad and has a tube cross-sectional area greater than a roll cross-sectional area of a rolled electronic heating pad having been rolled perpendicularly to the first edge around the cord and controller assembly, and the rolled pad is adapted to be inserted removably into the storage tube.

2. The electronic heating pad package as in claim 1, the package further comprising a cloth sleeve, wherein the cloth sleeve is adapted to cover the electronic heating pad.

3. The electronic heating pad package as in claim 2, wherein the cloth sleeve is made of a fabric including at least one of cotton, silk, polyester, nylon, acetate, lycra, and spandex.

4. The electronic heating pad package as in claim 2, wherein the sleeve is color-coded to indicate a variation in the electronic heating pad contained within the storage tube.

5. The electronic heating pad package as in claim 1, wherein the storage tube is made of one of cardboard, metal, and plastic and the lid is made of one of cardboard, metal and plastic.

6. The electronic heating pad package as in claim 5, wherein the storage tube is made of rigid, transparent plastic.

7. The electronic heating pad package as in claim 1, wherein the storage tube has a non-circular cross-section.

8. The electronic heating pad package as in claim 1, wherein the lid and the closed end have angular outer surfaces.

9. The electronic heating pad package as in claim 1, the package further comprising a hanging support.

10. The electronic heating pad package as in claim 1, wherein the lid attaches to the storage tube by one of being pushed into the tube, pushed onto the tube, screwed to the tube, hingedly secured to the tube and snapped to the tube.

11. A method of packaging an electronic heating pad in a point-of-sale storage device;

the electronic heating pad having a first edge and a cord and controller assembly coupled to heating wiring within the pad;

the point-of-sale storage device including a storage tube having a closed end and an open end, and a lid removably attachable to the open end of the storage tube;

the method including the following steps:

coiling the cord and controller assembly, placing the coiled cord and controller assembly substantially parallel to the first edge of the pad, rolling the pad substantially perpendicularly to the first edge so as to roll the pad around the coiled cord and controller assembly, inserting the rolled pad into the storage tube, and closing the storage tube with the lid.

12. The method of claim further comprising the following step:

inserting the rolled pad into a cloth sleeve prior to inserting the rolled pad into the storage tube.

* * * * *